US008564634B2

(12) United States Patent
Kokuta

(10) Patent No.: US 8,564,634 B2
(45) Date of Patent: Oct. 22, 2013

(54) ALIGNING DEVICE FOR PRINTING MEMBER IN PRINTER

(75) Inventor: Hiroshi Kokuta, Tokyo (JP)

(73) Assignee: Sato Holdings Kabushiki Kaisha (JP)

( * ) Notice: Subject to any disclaimer, the term of this patent is extended or adjusted under 35 U.S.C. 154(b) by 60 days.

(21) Appl. No.: 13/496,553

(22) PCT Filed: Feb. 18, 2010

(86) PCT No.: PCT/JP2010/001039
§ 371 (c)(1),
(2), (4) Date: Mar. 16, 2012

(87) PCT Pub. No.: WO2011/080849
PCT Pub. Date: Jul. 7, 2011

(65) Prior Publication Data

US 2012/0182369 A1 Jul. 19, 2012

(30) Foreign Application Priority Data

Dec. 28, 2009 (JP) ..... 2009-298652

(51) Int. Cl.
*B41J 17/30* (2006.01)

(52) U.S. Cl.
USPC ..... 347/217

(58) Field of Classification Search
USPC ..... 347/171, 215, 217, 222
See application file for complete search history.

(56) References Cited

U.S. PATENT DOCUMENTS 4,468,139 A * 8/1984 Hattori ..... 347/215
4,712,115 A * 12/1987 Tatsumi et al. ..... 347/217
4,919,553 A * 4/1990 Ueno et al. ..... 347/217
5,921,687 A * 7/1999 Koike et al. ..... 347/215

FOREIGN PATENT DOCUMENTS

JP 2001-192154 7/2001
JP 2008-87861 4/2008

OTHER PUBLICATIONS

International Search Report and Written Opinion (with translation) dated May 18, 2010 issued in connection with International Patent Application No. PCT/JP2010/001039.

* cited by examiner

*Primary Examiner* — Kristal Feggins
(74) *Attorney, Agent, or Firm* — Ostrolenk Faber LLP

(57) ABSTRACT

An aligning device for a printing member in a printer in which it is presupposed to use a printer of a one-end supporting structure. The printing member, such as a thermal transfer ribbon 3, can be used by selecting one of center alignment and one-end alignment. A rack and pinion structure within a cylindrical shaft 22 includes a pinion 16 rotatably provided within the cylindrical shaft 22, a pair of racks 17 and 18, a push-in projection 19 configured to push one rack 17 toward the push-in end 22B of the cylindrical shaft 22. A positioning projection 20 is configured to detachably engage with any of a plurality of positioning engagement holes 26 defined in the cylindrical shaft 22 along an axial direction. The push-in projection 19 drives the racks 17 and 18 and the pinion 16 by the pushing of the core tube 21 to the cylindrical shaft 22, and the positioning projection 20 engages with one of the positioning engagement holes 26 in the cylindrical shaft 22, to position the core tube 21 at the central position across the width direction.

7 Claims, 10 Drawing Sheets

ALIGNING DEVICE FOR PRINTING MEMBER IN PRINTER

The present application is a 35 U.S.C. §§371 national phase conversion of PCT/JP2010/001039, filed Feb. 18, 2010, which claims priority of Japanese Application No. 2009-298652, filed Dec. 28, 2009, the contents of which are incorporated by reference herein. The PCT International Application was published in the Japanese language.

TECHNICAL FIELD

The present invention relates to an aligning device for a printing member in a printer, and, in particular, to an aligning device for a printing member in a printer capable of feeding a printing member, such as rolled printing paper or an ink ribbon and a thermal transfer ribbon, to a transfer path in a strip, and of printing information of a predetermined content using the printing member.

BACKGROUND ART

Conventionally, in various types of printers, a printing member is loaded on and held by a supplying unit (such as a paper core and a ribbon core) for a printing member, such as printing paper or an ink ribbon and a thermal transfer ribbon. The printing member is held basically in one of the following manners: both-end supporting in which the core is supported at its both ends and the printing member is held therebetween, or one-end supporting in which the core is supported by only one end and the printing member is held by the supported end.

Further, methods of aligning the printing member across a width direction along a transfer path include a center alignment method for aligning the printing member in the center of the transfer path. This is often employed in both-end supporting and in a one-end alignment method for aligning the printing member on one end of the transfer path and is often employed in the one-end supporting.

In the both-end supporting, as the printing paper or the ribbon is centered, print heads such as a thermal head and the like in a printing unit are balanced on right and left, and a transfer resistance of the printing member is also balanced. This provides an advantage that wrinkling and meandering would not be likely to occur, especially in the case of thin thermal transfer ribbons. However, as the structure is complicated, there are problems of inconvenience in assembly and increased cost, and a problem that loading of the printing member becomes cumbersome.

On the other hand, in the one-end supporting, as the printing paper or the ribbon is aligned on one end, the print head in the printing unit is relatively unbalanced on the right and left, and the transfer resistance of the printing member is also relatively unbalanced. This provides an adverse effect that wrinkling and meandering could easily occur, especially in the case of thin thermal transfer ribbons. However, due to the simple structure, there are advantages that the assembly is facilitated, the cost is reduced, and the printing member can be loaded in a relatively simple manner.

As described above, both methods of aligning the printing member by both-end supporting and one-end supporting have, in connection with the center alignment and the one-end alignment, have advantages and disadvantages in their performance and cost. Many printers employ the one-end supporting aligning method considering many features, mainly the structure and cost.

However, taking the compatibility of printing data that a printer user has used in the past into account, a user who has been using a printer with one-end supporting or one-end alignment will have to select a printer of the structure of one-end supporting or one-end alignment under relatively poor conditions, such as the imbalance of the print head on the right and left or the transfer resistance, unless the user changes a processing method of the printing data to a processing method for both-end alignment (that is, unless the user changes the processing method so as to change a portion used by the print head) when using a printer with both-end supporting.

Conversely, when a user, who has been using a printer of center alignment and has been using the both-end supporting, later replaces the printer of both-end supporting with a printer of one-end alignment, the user is adversely required to convert printing data that has been processed to be printed using a central region of the print head in accordance with the one-end alignment so as to change the used portion of the print head to a large extent.

Therefore, after starting to use a printer of one-end alignment, if the user creates new printing data and uses the printer based on the printing data, the user has to continue using the printer of one-end alignment having the above problems unless entirely converting the printing data into data in accordance with the center alignment.

It should be noted that recognizing a width of a printing member when it is set on the supplying unit is necessary not only to detect erroneous setting of the printing member of a different width, but also to control the print processing using the printing member. Thus, there is a demand for providing ability for recognizing a width of the printing member that is set on the supplying unit.

Technical Problem

The present invention is made in view of the above problems, and an object of the present invention is to provide an aligning device for a printing member in a printer, the device capable of selectably using center alignment and one-end alignment as an alignment for the printing member, and presupposing to use a one-end supporting structure for the printer.

Another object of the present invention is to provide an aligning device for a printing member in a printer, in which a one-end supporting structure is employed, and the printing member can be loaded by the same operation both in the center alignment and the one-end alignment.

Yet another object of the present invention is to provide an aligning device for a printing member in a printer, in which the compatibility of printing data is taken into account while reducing cost by employing the one-end supporting structure.

A further object of the present invention is to provide an aligning device for a printing member in a printer, in which a user is able to change the aligning method of the printing member taking the compatibility of the printing data and printing quality into account such that the center alignment can be employed if the compatibility of the printing data is considered to be important and the one-end alignment if not.

Yet further another object of the present invention is to provide an aligning device for a printing member in a printer, in which, when the printing member is set in the supplying unit based on the center alignment, a width of the printing member can be automatically calculated and recognized.

SUMMARY OF THE INVENTION

Specifically, the present invention takes particular note in that it is presupposed to use the one-end supporting structure that employs the one-end alignment in holding the printing member, and that it is possible to align the printing member at a central portion of the transfer path when it is desired to employ the center alignment taking the printing data into account. To this end, an attachment tubular shaft having a cylindrical shaft and a one-side contact circular plate is provided with a rack and pinion structure within the cylindrical shaft. An aligning device for a printing member in a printer is provided having: a supplying unit configured to hold a rolled printing member in a one-end supporting manner; and a printing unit configured to print information of a predetermined content using the printing member that is fed in a strip from the supplying unit to a transfer path. The supplying unit includes: an attachment tubular shaft having a cylindrical shaft into which a core tube of the printing member is insertable from a free end of the cylindrical shaft and a one-side contact circular plate disposed at a push-in end of the cylindrical shaft on an opposite side of the free end. The attachment tubular shaft is rotatable as the printing member is fed from the cylindrical shaft to the transfer path. A pinion and a pair of racks are provided. The pinion is rotatably provided within the cylindrical shaft of the attachment tubular shaft on a center line across a width direction of the transfer path, and the pair of racks extends along an axial direction of the cylindrical shaft and are engaged with the pinion such that the pair of racks are movable in opposite directions from each other. A push-in projection is provided at a one-side contact end of one of the racks to project in a radial direction of the cylindrical shaft. The projection is configured to push the one rack toward the push-in end of the cylindrical shaft by means of the core tube of the printing member. A positioning projection is swingably attached to a positioning end of the other of the racks, and is configured to detachably engage with any of a plurality of positioning engagement holes defined in the cylindrical shaft at a predetermined interval along the axial direction. The push-in projection drives the racks and the pinion by the pushing of the core tube toward the push-in end of the cylindrical shaft. The positioning projection engages with one of the positioning engagement holes in the cylindrical shaft at a position at which the core tube is determined to be at a central position across the width direction of the transfer path, whereby the core tube is positioned at the central position across the width direction.

The aligning device can be such that the one-side contact circular plate of the attachment tubular shaft faces toward a printing member width measuring plate that rotates in conjunction with the pinion, the printing member width measuring plate rotates as the core tube of the printing member pushes into the cylindrical shaft, thereby providing a predetermined width correspondent interval from the one-side contact circular plate. As the printing member is fed from the core tube to the transfer path, the one-side contact circular plate rotates while maintaining the width correspondent interval from the printing member width measuring plate, and the width correspondent interval is measured along with this rotation, thereby allowing calculation of a width of the printing member.

The aligning device can be such that the cylindrical shaft includes therein: a first pulley configured to rotate coaxially with the pinion; a belt that is wound around the first pulley; a second pulley around which the belt is wound; and a bevel gear provided for the second pulley. The printing member width measuring plate rotates by means of the bevel gear, thereby allowing measurement of the width of the printing member.

The aligning device can further include a rack biasing member configured to bias at least one of the racks such that the at least one of the racks is provided so as to decrease the width corresponding to the printing member attached to the cylindrical shaft.

The aligning device can further include a projection biasing member configured to bias the positioning projection such that the positioning projection engages with an end of the core tube through the positioning engagement hole.

The aligning device can further include a hollow core insertable into the cylindrical shaft in an identical manner with the core tube of the printing member, wherein the hollow core is configured to push the push-in projection toward the one-side contact circular plate, and cause the positioning projection to be set into the cylindrical shaft.

The aligning device can further include a sectorial locking plate configured to maintain the positioning projection to be set into the cylindrical shaft after the hollow core pushes the push-in projection to the one-side contact circular plate and then is pulled out of the cylindrical shaft.

The printing member can be a printing material of any structure used in a printing operation such as a thermal transfer ribbon for a thermal transfer printer, for example, as well as printing paper on which information is printed.

Advantageous Effects of Invention

According to the aligning device for the printing member in the printer of the present invention, an attachment tubular shaft having a cylindrical shaft and a one-side contact circular plate is provided, in the cylindrical shaft, with a pinion rotatably disposed on a center line across a width direction of the transfer path and a pair of racks extending along an axial direction of the cylindrical shaft and being engaged with the pinion such that the pair of racks are movable in opposite directions from each other, and a push-in projection drives the racks and the pinion by pushing a core tube toward a push-in end of the cylindrical shaft, and whereby the core tube can be positioned at a central position across the width direction of the transfer path. Therefore, it is possible to use the center alignment as needed while the one-end supporting structure is employed.

In addition, an operation of attachment of the core tube to the cylindrical shaft of the attachment shaft is the same in both the one-end supporting and the center alignment, and a user of the printer need not learn a new or different operation procedures.

Further, taking the compatibility of printing data into account, it is possible to maintain the balance of a print head on the right and left and a transfer resistance at a favorable level, even when printing data that has been used in a printer of the both-end supporting or center alignment is used in a printer of the one-end supporting or one-end alignment.

DESCRIPTION OF EMBODIMENTS

The present invention intends to provide advantages of both one-end supporting and both-end supporting by providing a pinion and a pair of racks within a cylindrical shaft of an attachment tubular shaft, and thus realizes an aligning device for a printing member in a printer which uses an aligning method of a printing member selectably between center alignment and one-end alignment while intended to reduce cost.

Embodiment

The following describes the aligning device for the printing member in the printer according to an embodiment of the present invention with reference to FIG. 1 through FIG. 10, taking a thermal transfer ribbon and a continuous label body as examples of the printing member.

Figure 1:
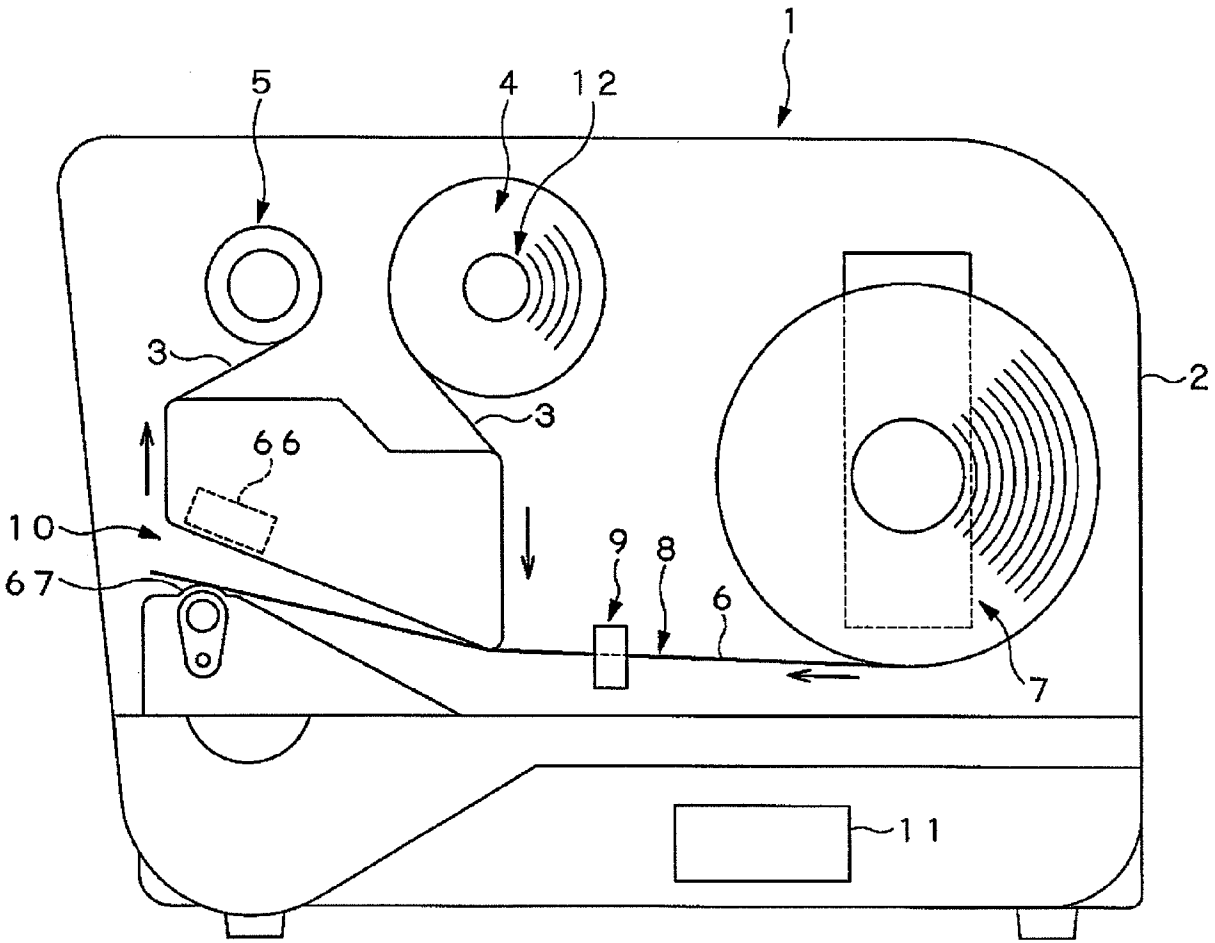
FIG. 1 is a side view schematically illustrating a printer (thermal printer 1) provided with an aligning device 12 for a printing member (thermal transfer ribbon 3) according to an embodiment of the present invention.

FIG. 1 is a side view schematically illustrating the printer (thermal printer 1). The thermal printer 1 is provided with a printer housing 2, a supplying unit 4 configured to hold a rolled thermal transfer ribbon 3 in a one-end supporting manner, a winding unit 5 for the thermal transfer ribbon 3, a supplying unit 7 configured to hold a rolled continuous label body 6 in the one-end supporting manner, a transfer path 8, a label guiding unit 9 disposed in the middle of the transfer path 8, a printing unit 10, and a controlling unit 11.

In the printer housing 2, the thermal transfer ribbon 3 is held by the supplying unit 4 in the one-end supporting manner, and the continuous label body 6 is held by the supplying unit 7 in the one-end supporting manner, and also the transfer path 8 is provided from the supplying unit 4 for the thermal transfer ribbon 3 to the winding unit 5 and from the supplying unit 7 for the continuous label body 6 to the printing unit 10.

The supplying unit 4 for the thermal transfer ribbon 3 is provided with an aligning device 12 for the printing member (thermal transfer ribbon 3) according to this embodiment.

Figure 2:
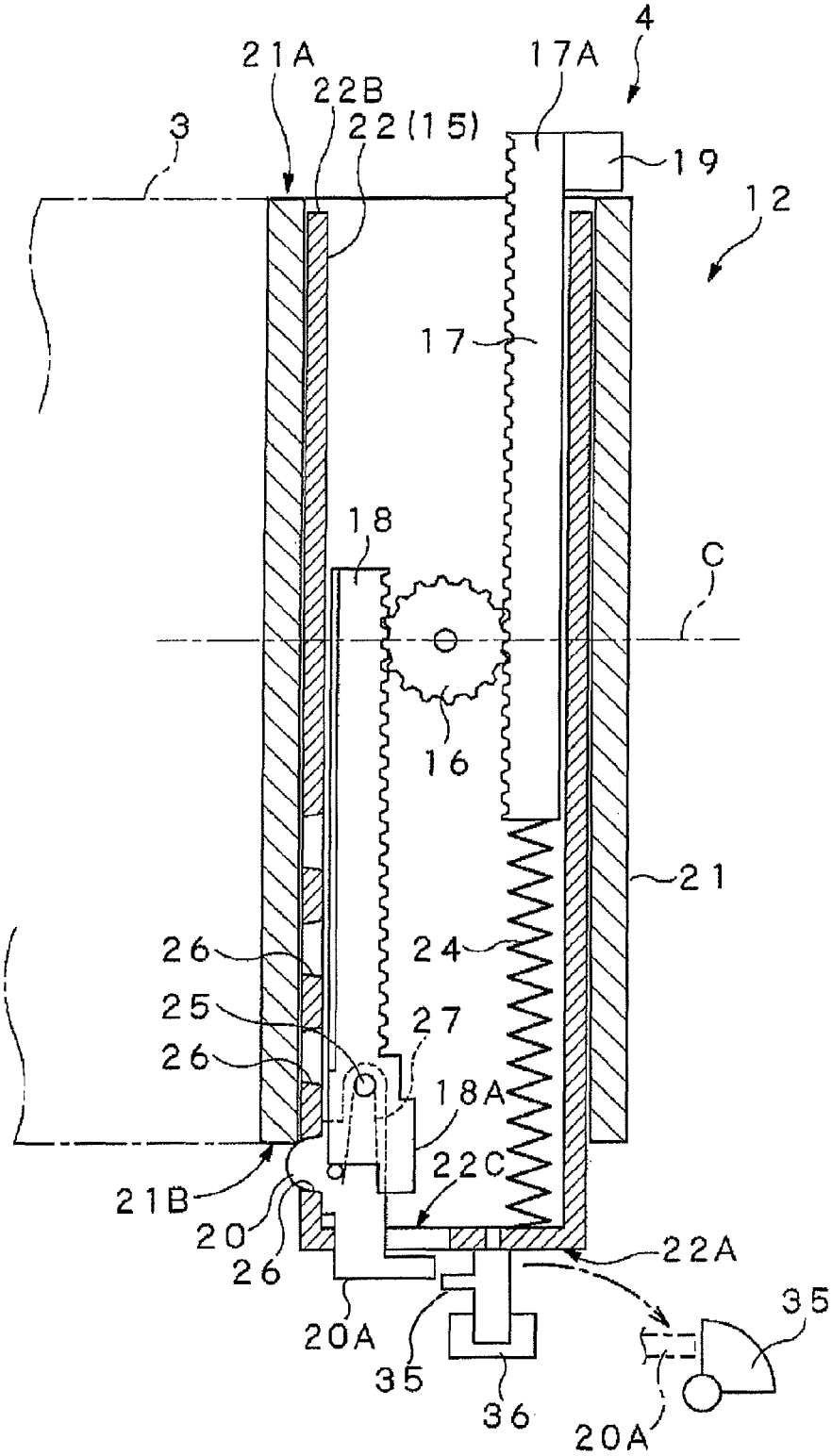
FIG. 2 is a cross-sectional view of a main portion of the aligning device 12, in particular, a cylindrical shaft 22 on a side of a free end 22A according to the embodiment of the present invention.
Figure 3:
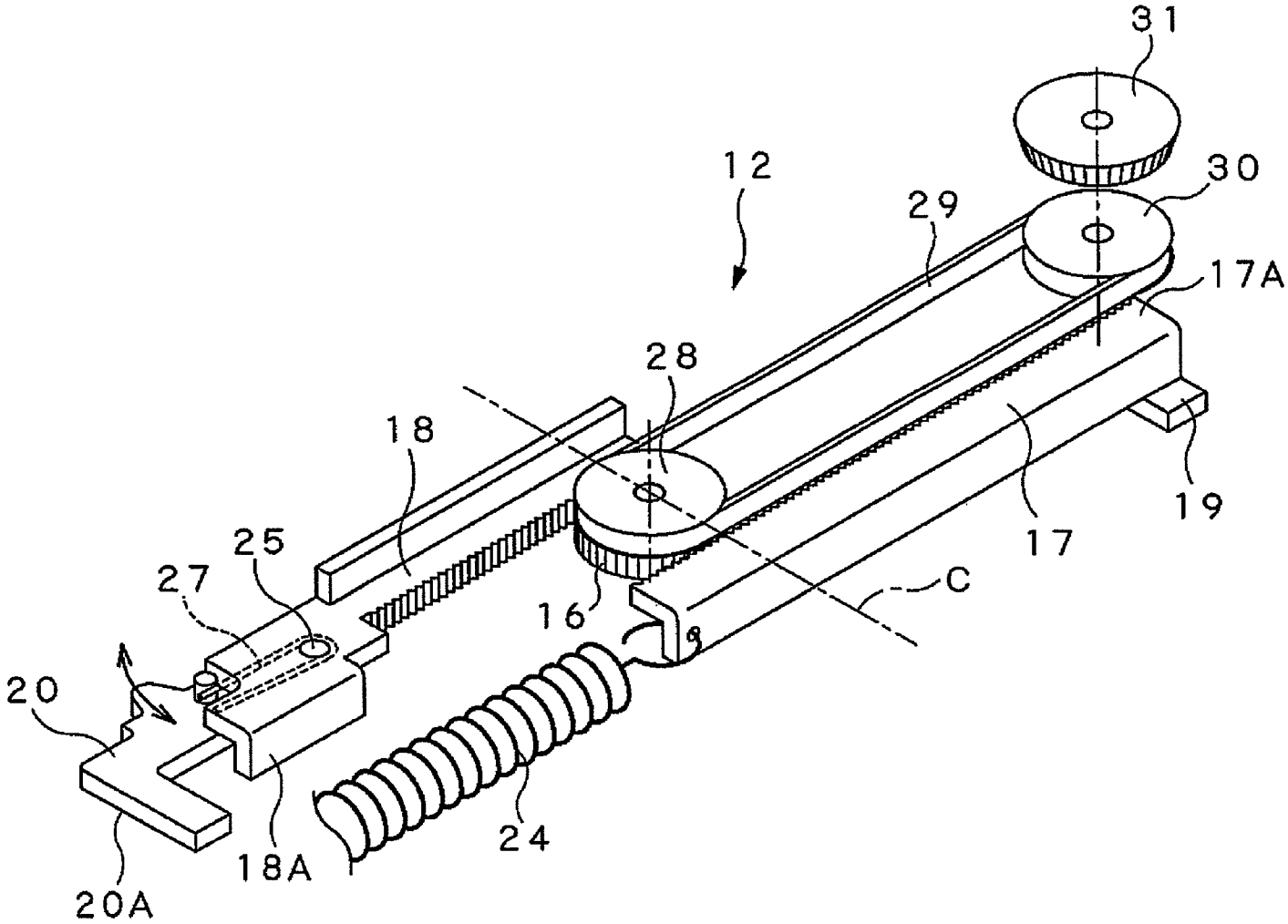
FIG. 3 is a perspective view of a main portion of the aligning device 12, in particular, a pinion 16 and a pair of racks (first and second racks 17 and 18) according to the embodiment of the present invention.
Figure 4:
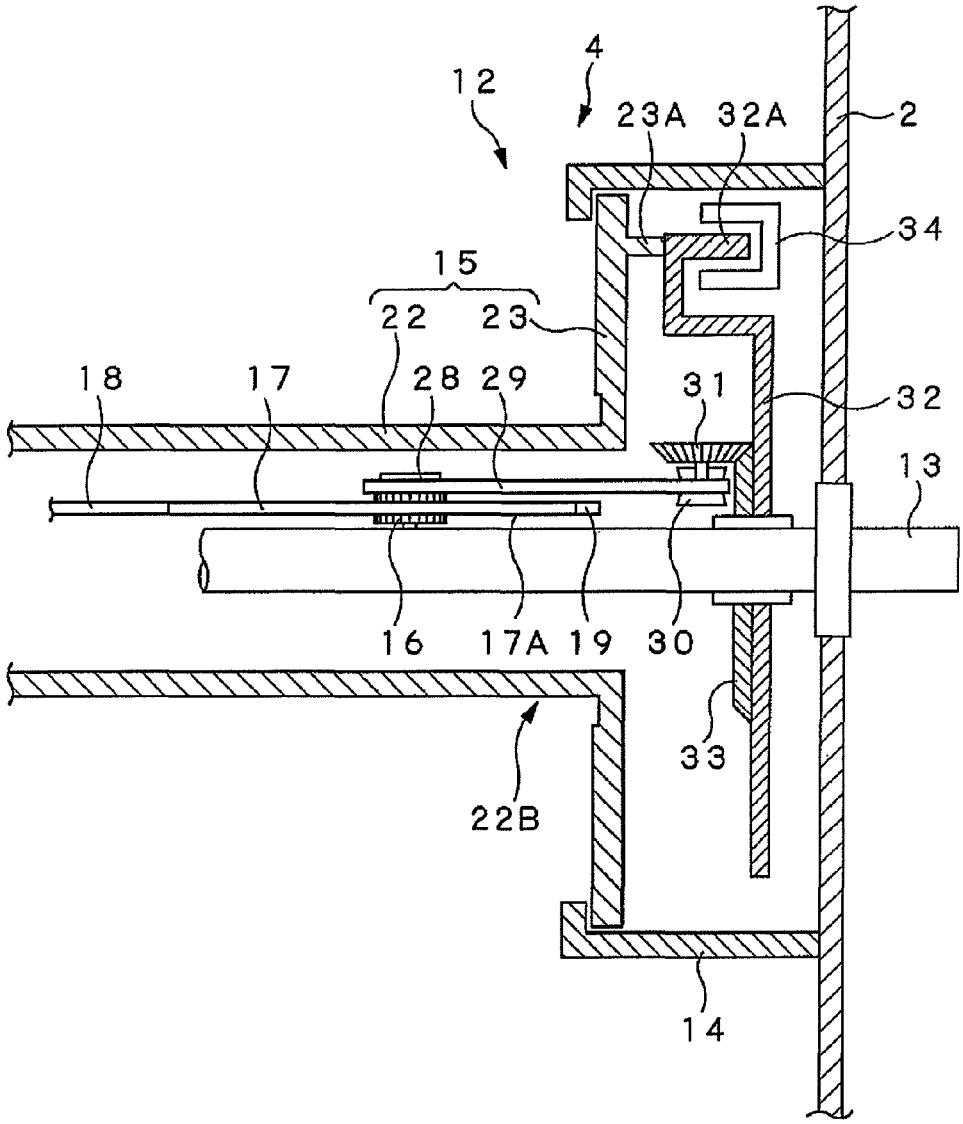
FIG. 4 is a cross-sectional view of a main portion of the aligning device 12, in particular, on a side of a one-side contact circular plate 23 according to the embodiment of the present invention.

FIG. 2 is a cross-sectional view of a main portion of the aligning device 12, in particular, a cylindrical shaft 22, on a side of a free end 22A, FIG. 3 is a perspective view of a main portion of the aligning device 12, in particular, a pinion 16 and a pair of racks (first and second racks 17 and 18), and FIG. 4 is a cross-sectional view of a main portion of the aligning device 12, in particular, on a side of a one-side contact circular plate 23.

As shown, especially, in FIG. 4, the aligning device 12 is provided with a supporting shaft 13 rotatably attached to the printer housing 2, an attachment tubular shaft 15 rotatably attached to a supporting cylinder 14 fixed to the printer housing 2, the pinion 16 and the pair of racks (first racks 17 and 18, FIG. 2 and FIG. 3), a push-in projection 19 (FIG. 2 and FIG. 3), and a positioning projection 20 (FIG. 2 and FIG. 3).

The attachment tubular shaft 15 includes the cylindrical shaft 22 onto which a core tube 21 of the thermal transfer ribbon 3 is insertable from the free end 22A (FIG. 2) of the cylindrical shaft 22, and the one-side contact circular plate 23 (FIG. 4) disposed at a push-in end 22B of the cylindrical shaft 22 on an opposite side of the free end 22A.

The attachment tubular shaft 15 is rotatable as the thermal transfer ribbon 3 is fed to the transfer path 8 directed toward the printing unit 10 and the winding unit from the cylindrical shaft 22.

The pinion 16 is rotatably provided on the supporting shaft 13 within the cylindrical shaft 22 of the attachment tubular shaft 15 such that a rotation axis of the pinion 16 is aligned with a center line C across a width direction of the transfer path 8.

The first rack 17 and the second rack 18 extend along an axial direction of the cylindrical shaft 22, and are engaged with the pinion 16 and movable in opposite directions from each other.

There is provided an extension spring 24 (rack biasing member) configured to bias the pinion 16 such that the first rack 17 is provided so as to decrease a width corresponding to the thermal transfer ribbon 3 attached to the cylindrical shaft 22.

The push-in projection 19 is provided at a one-side contact end 17A of the first rack 17 so as to project in a radial direction of the cylindrical shaft 22, and able to push the rack from the free end 22A to the push-in end 22B of the cylindrical shaft 22 by means of a push-in side end 21A of the core tube 21 of the thermal transfer ribbon 3.

The positioning projection 20 is attached to a positioning end 18A of the second rack 18 so as to be swingable around a swing shaft 25, and detachably engaged with any of a plurality of positioning engagement holes 26 defined in the cylindrical shaft 22 at a predetermined interval along the axial direction.

Figure 5:
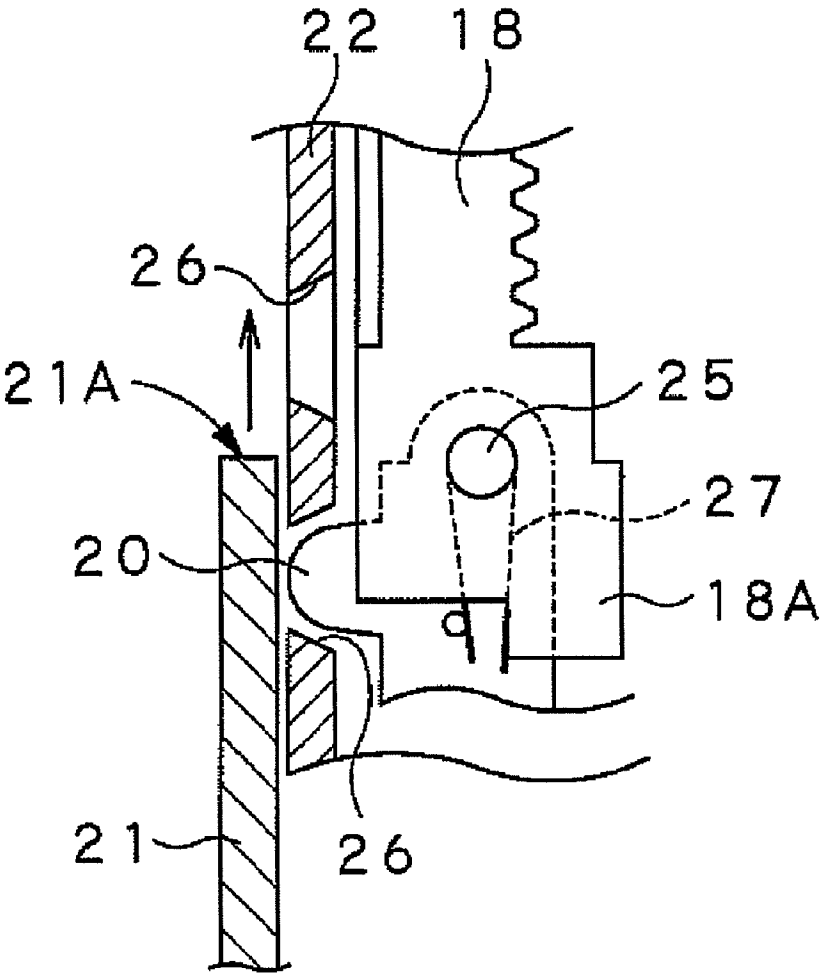
FIG. 5 is an enlarged cross-sectional view of a main portion in which a positioning projection 20 is fitted into a positioning engagement hole 26 according to the embodiment of the present invention.

FIG. 5 is an enlarged cross-sectional view of a main portion in which the positioning projection 20 is fitted into one of the positioning engagement holes 26. The swing shaft 25 is provided with a torsion spring 27 (projection biasing member), and the positioning projection 20 is biased by the torsion spring 27 so as to engage with a positioning side end 21B (FIG. 2) of the core tube 21 through the positioning engagement holes 26. The core tube 21 can be pushed onto the cylindrical shaft 22 from the push-in side end 21A of the core tube 21 against the biasing force of the torsion spring 27.

As shown, especially, in FIG. 3 and FIG. 4, within the cylindrical shaft 22, there are provided a first pulley 28 configured to rotate coaxially with the pinion 16, a belt, preferably a toothed belt 29, that is wound around the first pulley 28, a second pulley 30 around which the toothed belt 29 is wound, and a first bevel gear 31 provided for the second pulley 30.

A thermal transfer ribbon width measuring plate 32 is rotatably provided for the supporting shaft 13. The thermal transfer ribbon width measuring plate 32 is able to measure a width of the thermal transfer ribbon 3 by providing a second bevel gear 33 that is engaged with the first bevel gear 31, and causing the thermal transfer ribbon width measuring plate 32 to rotate by the first bevel gear 31 and the second bevel gear 33.

Figure 6:
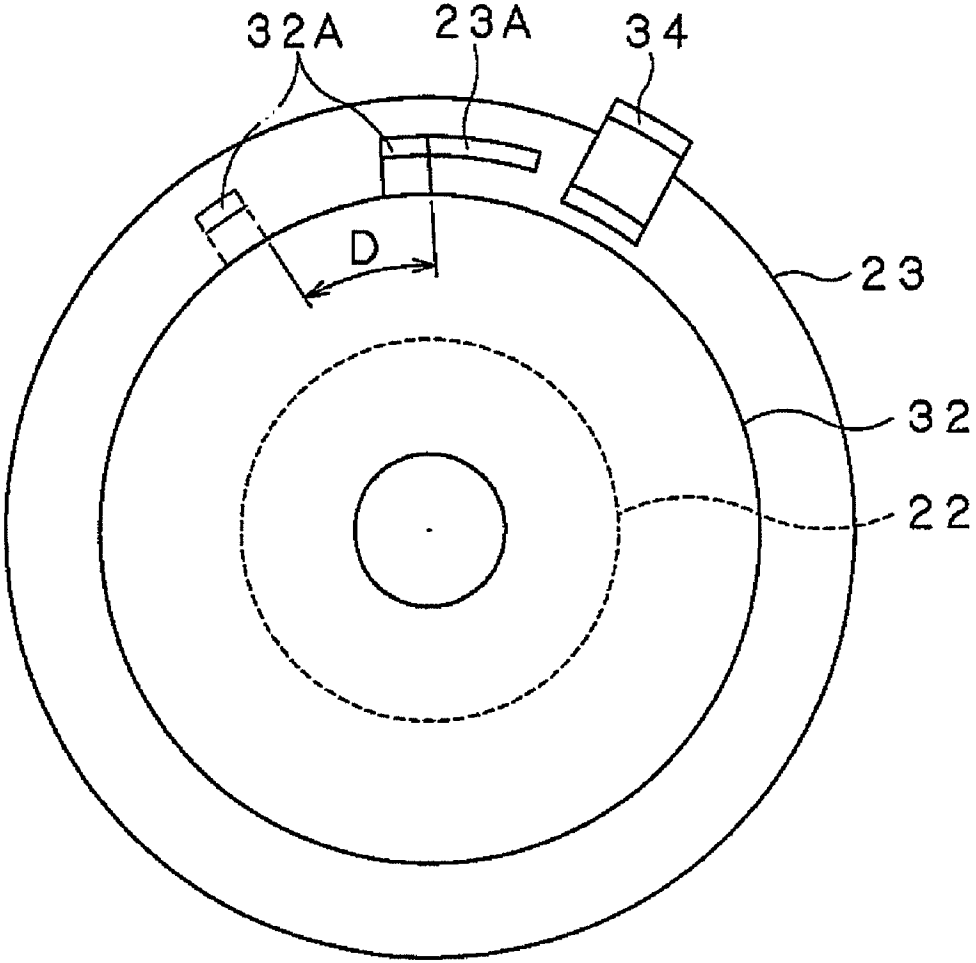
FIG. 6 is a side view illustrating the cylindrical shaft 22, the one-side contact circular plate 23, and a thermal transfer ribbon width measuring plate 32, viewed from an axial direction of the components according to the embodiment of the present invention.

Specifically, FIG. 6 is a side view illustrating the cylindrical shaft 22, the one-side contact circular plate 23, and the thermal transfer ribbon width measuring plate 32 viewed from the axial direction, and the one-side contact circular plate 23 of the attachment tubular shaft 15 faces toward the thermal transfer ribbon width measuring plate 32 that rotates in conjunction with the pinion 16 to the first bevel gear 31 and the second bevel gear 33, as described above.

More specifically, as shown in FIG. 4 and FIG. 6, a first measurement end portion 23A of the one-side contact circular plate 23 provided so as to project in a radial direction of the one-side contact circular plate 23 and a second measurement end portion 32A of the thermal transfer ribbon width measuring plate 32 provided so as to project in a radial direction of the thermal transfer ribbon width measuring plate 32 are disposed adjacent to each other along a circumferential direction, in a state in which neither the thermal transfer ribbon 3 nor the core tube 21 is loaded onto the cylindrical shaft 22.

As the core tube 21 of the thermal transfer ribbon 3 is pushed onto the cylindrical shaft 22, the thermal transfer ribbon width measuring plate 32 rotates with respect to the one-side contact circular plate 23. Further, along with the rotation of the thermal transfer ribbon width measuring plate 32, the second measurement end portion 32A of the thermal transfer ribbon width measuring plate 32 is disposed with a predetermined width correspondent interval D from the first measurement end portion 23A of the one-side contact circular plate 23 in a circumferential direction. This width correspondent interval D is measured by a sensor (e.g., photointerrupter 34), and it is possible to calculate the width of the thermal transfer ribbon 3 using the controlling unit 11 based on the width correspondent interval D.

Specifically, the one-side contact circular plate 23 rotates while maintaining the width correspondent interval D from the thermal transfer ribbon width measuring plate 32 during an initial loading operation of the thermal transfer ribbon 3 to the transfer path 8 from the core tube 21 that continues after the loading of the thermal transfer ribbon 3 to the attachment tubular shaft 15. The width correspondent interval D is measured based on this rotation, and whereby it is possible to calculate the width of the thermal transfer ribbon 3.

In this case, as shown, especially, in FIG. 2 and FIG. 7 that will be later described, the free end 22A of the cylindrical shaft 22 is provided with a sectorial locking plate 35 that is turnable by a locking knob 36.

The sectorial locking plate 35 is positioned outward of a locking end 20A of the positioning projection 20 from the positioning end 18A of the second rack 18.

The sectorial locking plate 35 is engaged with the locking end 20A by operating the locking knob 36 when attaching the thermal transfer ribbon 3 (core tube 21) to the attachment tubular shaft 15 in the one-end alignment manner using a hollow core 37 (FIG. 7) that will be later described, and is able to prevent the positioning projection 20 from swinging about the swing shaft 25 in a clockwise direction shown in FIG. 2 (and FIG. 7).

Specifically, only when the push-in projection 19 is pushed to a most inward portion (one-side contact circular plate 23) of the attachment shaft 15 and the first rack 17 and the second rack 18 are positioned distant from each other at a maximum, the sectorial locking plate 35 is used to fix positions of the first rack 17 and the second rack 18, that is a position of the positioning projection 20, against the biasing force of the extension spring 24.

In this case, the free end 22A of the cylindrical shaft 22 is provided with a through hole 22C through which the locking end 20A is movable in and out the cylindrical shaft 22.

In particular, the position of the positioning projection 20 in FIG. 2 shows a case in which the width of the thermal transfer ribbon 3 is relatively large taking such as a maximum width, and when loading the thermal transfer ribbon 3 of a smaller width, the locking end 20A is movable into the cylindrical shaft 22 through the through hole 22C as the movement of the second rack 18 and the positioning projection 20.

In this manner, the push-in projection 19 drives the first rack 17, the second rack 18, and the pinion 16 by the pushing of the core tube 21 toward a side of the push-in end 22B of the cylindrical shaft 22, and the positioning projection 20 engages with one of the positioning engagement holes 26 in the cylindrical shaft 22 at a position at which the core tube 21 is determined to be at a central position across the width direction of the transfer path 8, and whereby the core tube 21 is positioned at the central position across the width direction.

In the aligning device 12 for the printing member (thermal transfer ribbon 3) according to the present invention, the thermal transfer ribbon 3 (core tube 21) can also be attached to the attachment tubular shaft 15 in the one-end alignment manner.

Figure 7:
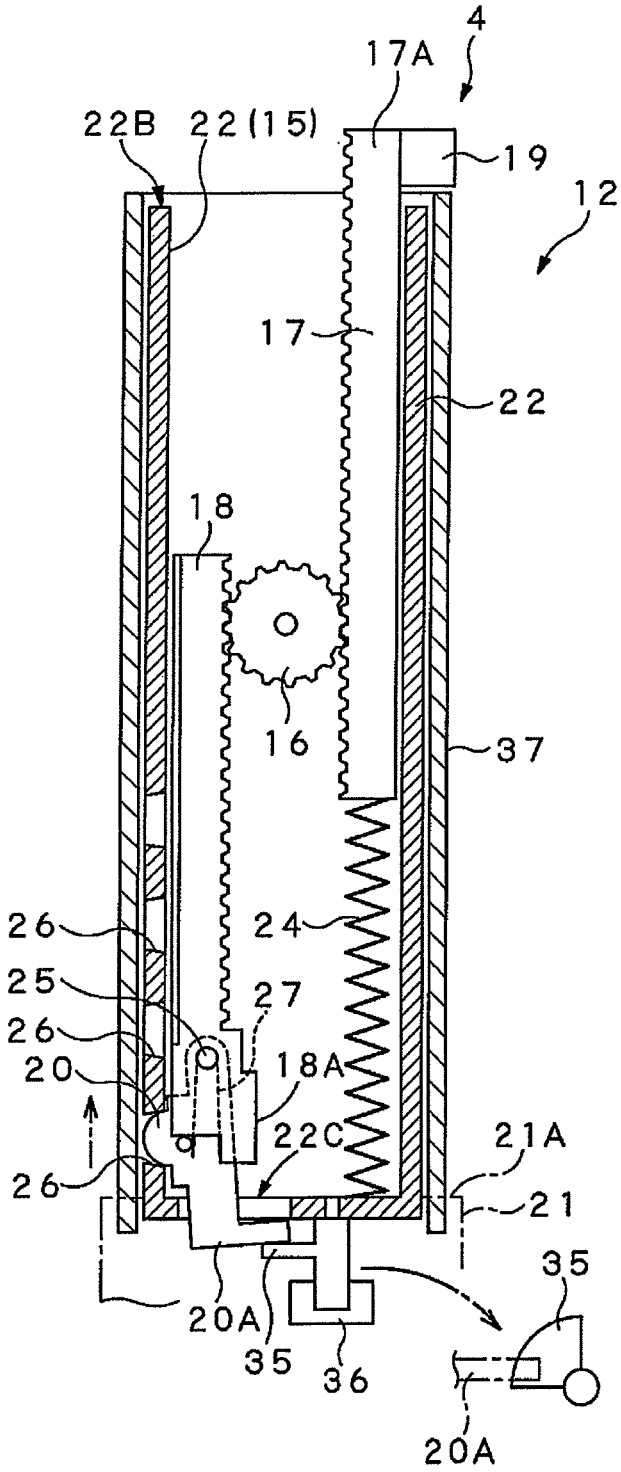
FIG. 7 is a cross-sectional view of a main portion of the aligning device 12 in which a hollow core 37 is fitted into the cylindrical shaft 22 from a side of the free end 22A of the cylindrical shaft 22 according to the embodiment of the present invention.

Specifically, FIG. 7 is a cross-sectional view of a main portion of the aligning device 12 in which the hollow core 37 is fitted onto the cylindrical shaft 22 from a side of the free end 22A of the cylindrical shaft 22.

The hollow core 37 is insertable onto the cylindrical shaft 22 similarly to the core tube 21, and has substantially the same length as a maximum length of the cylindrical shaft 22. The positioning projection 20 can remain setting into the cylindrical shaft 22, even if the hollow core 37 pushes the push-in projection 19 of the first rack 17 to the one-side contact circular plate 23.

Operating the locking knob 36 in this set-in state to turn and set the sectorial locking plate 35 so as to engage with the locking end 20A of the positioning projection 20 allows the positioning projection 20 to be locked at the set-in position.

Therefore, even if the hollow core 37 is pulled out of the cylindrical shaft 22, the sectorial locking plate 35 prevents the positioning projection 20 from swinging about the swing shaft 25 in the clockwise direction in FIG. 2 (and FIG. 7), that is, prevents the positioning projection 20 from projecting outward of the cylindrical shaft 22 through the positioning engagement hole 26. Accordingly, it is possible to maintain the positioning projection 20 in the set-in state within the cylindrical shaft 22.

In this manner, even when the thermal transfer ribbon 3 and the core tube 21 of the thermal transfer ribbon 3 are pushed onto the cylindrical shaft 22 in the state in which the hollow core 37 is taken out of the cylindrical shaft 22, the first rack 17, and in turn the positioning projection 20, would not be actuated. Accordingly, the thermal transfer ribbon 3 and the core tube 21 of the thermal transfer ribbon 3 can be pushed until its end on a side of the most inward portion (push-in side end 21A of the core tube 21) is brought into contact with the one-side contact circular plate 23, and thus can be attached to the attachment tubular shaft 15 in the state of one-end aligning with the one-side contact circular plate 23.

Further, by operating the locking knob 36 to unset the sectorial locking plate 35 out of the locking end 20A, and making the positioning projection 20 swingable about the swing shaft 25, it is possible to set the core tube 21 in the cylindrical shaft 22 in the center alignment manner as described above.

Figure 8:
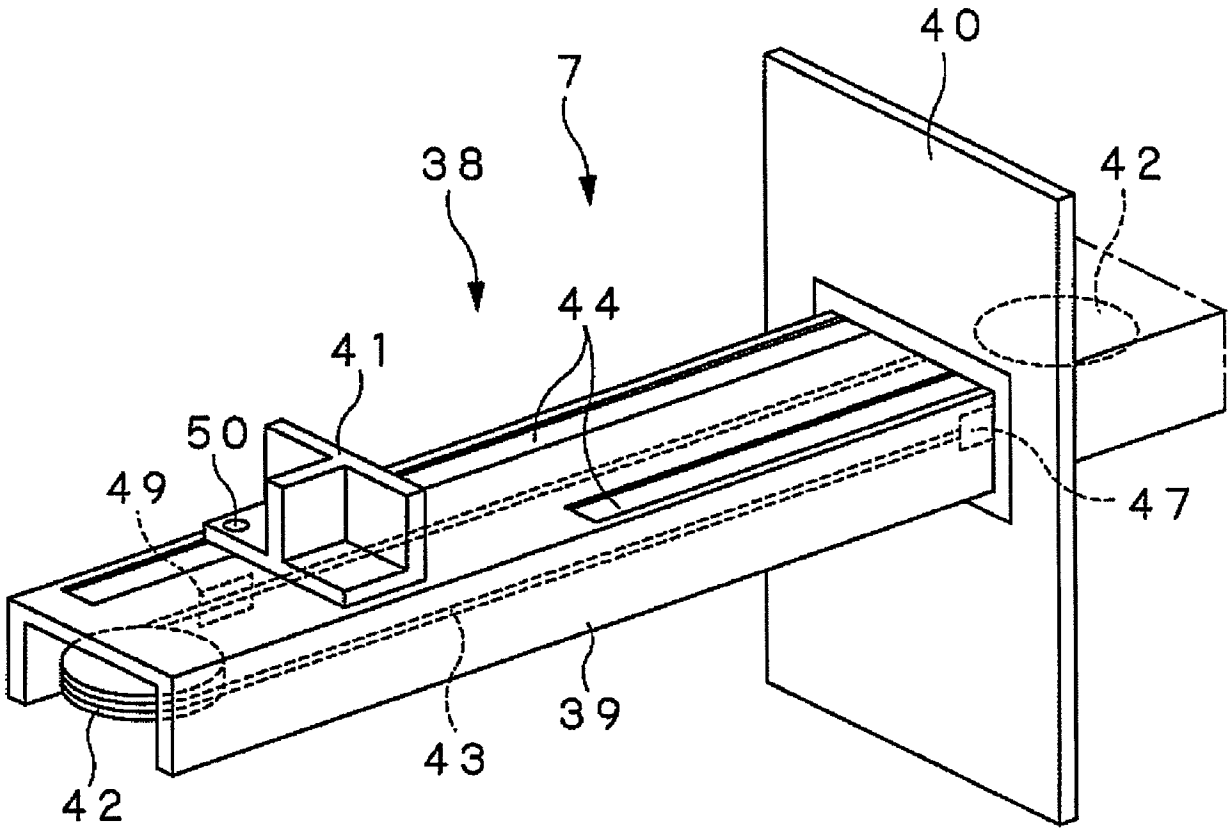
FIG. 8 is a perspective view illustrating an aligning device 38 for a continuous label body 6 in a supplying unit 7 according to the embodiment of the present invention.

Next, FIG. 8 is a perspective view illustrating an aligning device 38 for a continuous label body 6 in the supplying unit 7. The aligning device 38 is configured to hold the continuous label body 6 in accordance with the aligning device 12 for the thermal transfer ribbon 3 in the supplying unit 4 as described above, that is, in accordance with the alignment of the thermal transfer ribbon 3: the center alignment or the one-end alignment.

The aligning device 38 is provided with a supporting shaft 39, a one-side contact plate 40 and an aligning plate 41. The continuous label body 6 can be aligned between the plates 40 and 41. A pair of separated pulleys 42 are provided within the supporting shaft 39. A belt, preferably a toothed belt 43, is wound around the pulleys 42.

Here, the supporting shaft 39 is provided with a pair of parallel grooves 44 along its axial direction.

Figure 9:
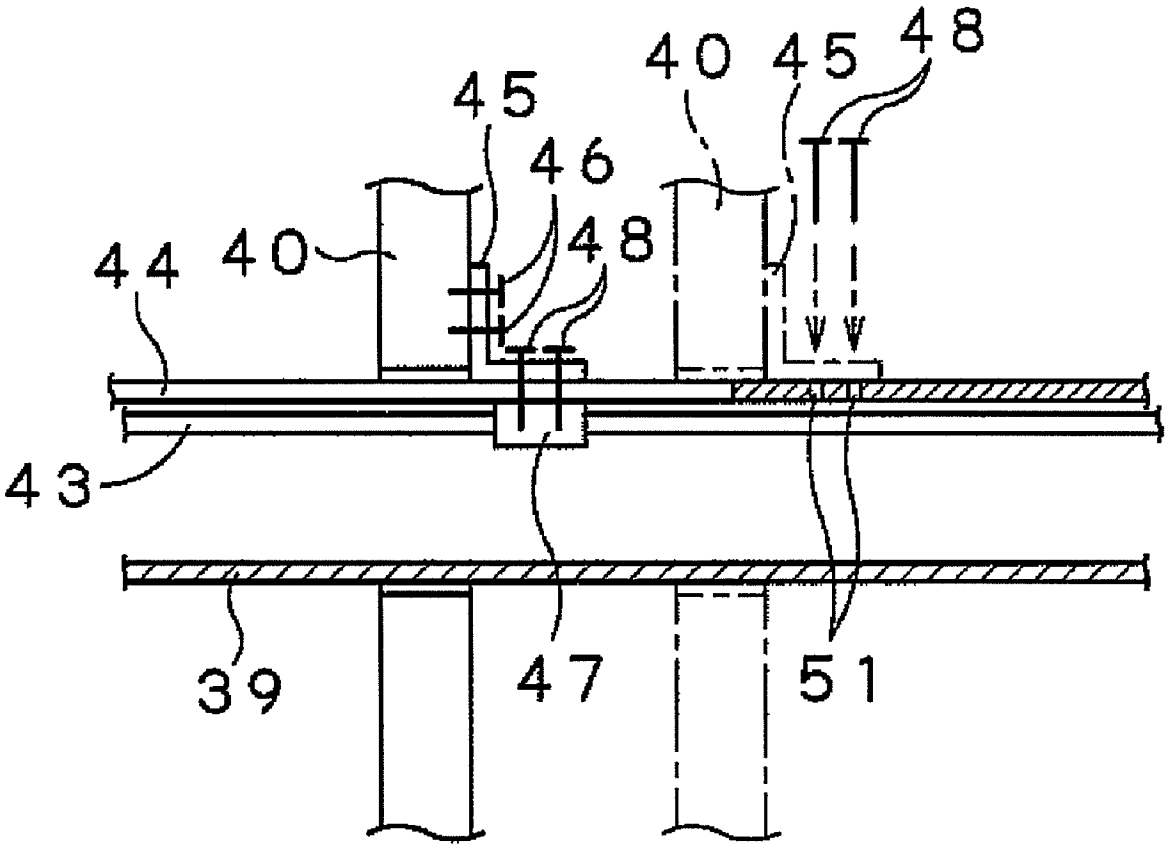
FIG. 9 is a side view of a main portion of a side of a one-side contact plate 40 that is opposite of an aligning plate 41 according to the embodiment of the present invention.

FIG. 9 is a side view of a main portion of a side of the one-side contact plate 40 that is opposite the aligning plate 41. The one-side contact plate 40 is fixed to the toothed belt 43 by an L-shaped plate 45, a bolt 46, a belt fixing piece 47, and bolts 48 that penetrate through the grooves 44, so that the plate 40 is movable integrally with the toothed belt 43.

Figure 10:
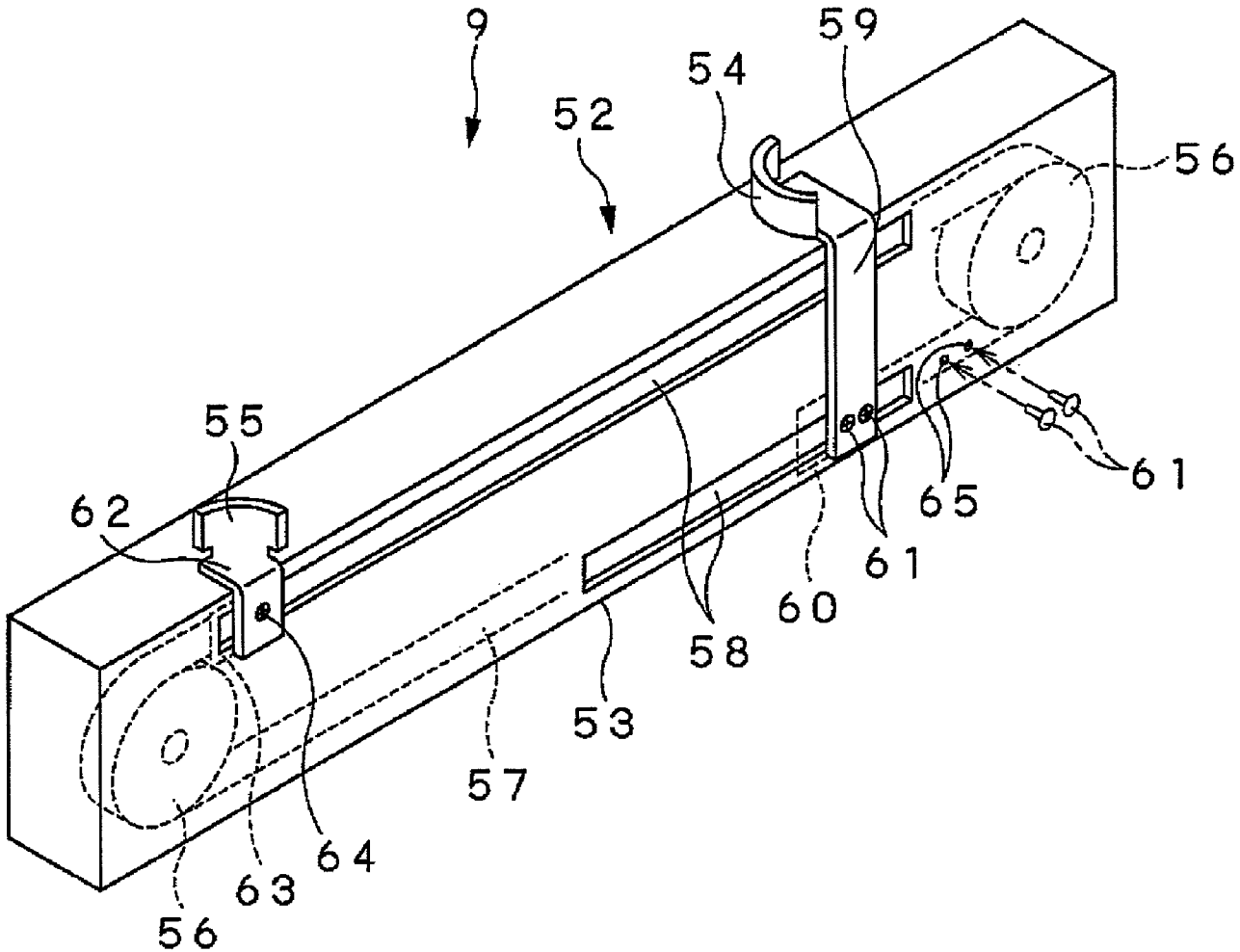
FIG. 10 is a perspective view illustrating an aligning device 52 for the continuous label body 6 in a label guiding unit 9 according to the embodiment of the present invention.

Similarly, in FIG. 10 the aligning plate 41 is fixed to the toothed belt 43 by a belt fixing piece 49 and bolts 50 that penetrate through the grooves 44, so that the plate 41 is movable integrally with the toothed belt 43.

The one-side contact plate 40 and the aligning plate 41 are respectively fixed to the opposite direction runs of the toothed belt 43 that is at positions on the belt that divide a perimeter of the toothed belt 43 by half. When one of the one-side contact plate 40 and the aligning plate 41 is operated manually, it is possible to align the continuous label body 6 at the central position of the transfer path 8 along with the conjunctive movement of the toothed belt 43.

Further, one-end aligning bolt holes 51 are defined in the supporting shaft 39 at positions different from the positions of the grooves 44. When holding the continuous label body 6 in the one-end alignment manner in the aligning device 38, the bolts 48 are held out of the belt fixing piece 47, and are thereafter screwed into the one-end aligning bolt holes 51, as shown by an imaginary line in FIG. 9. This makes it possible to fix the one-side contact plate 40 to the supporting shaft 39 independently from the toothed belt 43 and the aligning plate 41 without using the belt fixing piece 47.

FIG. 10 is a perspective view illustrating an aligning device 52 for the continuous label body 6 in the label guiding unit 9. The aligning device 52 is configured to guide the continuous label body 6 in accordance with the aligning device 12 for the thermal transfer ribbon 3 in the supplying unit 4 and the aligning device 38 for the continuous label body 6 in the supplying unit 7, that is, in accordance with the alignment of the thermal transfer ribbon 3 and the continuous label body 6: the center alignment or the one-end alignment.

The aligning device 52 is provided with a supporting shaft 53, a one-side contact plate 54 and a guiding plate 55. The continuous label body 6 can be guided between the one-side contact plate 54 and the guiding plate 55. A pair of pulleys 56 are provided within the supporting shaft 53. A belt, preferably a toothed belt 57, is wound around the pulleys 56.

The supporting shaft 53 is provided with a pair of parallel grooves 58 along its axial direction.

The one-side contact plate 54 is fixed to the toothed belt 57 by a bent plate 59, a belt fixing piece 60, and bolts 61 that penetrate through the groove 58, and the plate 54 is movable integrally with the toothed belt 57.

Similarly, the guiding plate 55 is also fixed to the toothed belt 57 by a bent plate 62, a belt fixing piece 63, and a bolt 64 that penetrates through the groove 58, so that the guiding plate is movable integrally with the toothed belt 57.

However, the one-side contact plate 54 and the guiding plate 55 are respectively fixed to the two opposite runs of toothed belt 57 at positions that divide a perimeter of the toothed belt 57 by half, so that when one of the one-side contact plate 54 and the guiding plate 55 is operated manually, it is possible to guide the continuous label body 6 at the central position of the transfer path 8 along with the conjunctive movement of the toothed belt 57.

Further, one-end aligning bolt holes 65 are defined in the supporting shaft 53 at positions different from the positions of the grooves 58. When guiding the continuous label body 6 in the one-end alignment manner in the aligning device 52, the bolts 61 are set out of the belt fixing piece 60, and then screwed into the one-end aligning bolt holes 65 as shown by an imaginary line in FIG. 10. With this, it is possible to fix the one-side contact plate 54 to the supporting shaft 53 independently from the toothed belt 57 and the guiding plate 55 without using the belt fixing piece 60.

Referring back to FIG. 1, the printing unit 10 is provided with a thermal head 66 and a platen roller 67, and prints information of a predetermined content on the continuous label body 6 using the thermal transfer ribbon 3 fed in a strip from the supplying unit 4 to the transfer path 8 and the continuous label body 6 fed in a strip from the supplying unit 7 to the transfer path 8.

The controlling unit 11 is able to calculate the width of the thermal transfer ribbon 3 based on the width correspondent interval D (FIG. 6) measured by the photointerrupter 34 as described above, and not only detects erroneous setting of the thermal transfer ribbon 3 of a different width, but also controls the print processing using the thermal transfer ribbon 3 and the continuous label body 6.

According to the thermal printer 1 (FIG. 1), the aligning device 12 (FIG. 2 through FIG. 7), the aligning device 38 (FIG. 8 and FIG. 9), and the aligning device 52 (FIG. 10) that have been thus configured, first, in the supplying unit 4, the thermal transfer ribbon 3, along with the core tube 21 of the thermal transfer ribbon 3, is inserted into the cylindrical shaft 22 of the attachment tubular shaft 15 of the aligning device 12, the core tube 21 pushes the push-in projection 19 toward the one-side contact circular plate 23, the push-in projection 19 moves toward the one-side contact circular plate 23 by the pushing operation, the pinion 16 and the first and the second racks 17 and 18 are actuated by this movement, the core tube 21 moves along the cylindrical shaft 22 while the positioning projection 20 engages and disengages with the positioning engagement holes 26, the core tube 21 is prevented from being taken out in the state in which the positioning projection 20 projected from one of the positioning engagement holes 26 is engaged with the positioning side end 21B of the core tube 21, and whereby the thermal transfer ribbon 3 is positioned at the central position of the transfer path 8 in this engagement state.

In this manner, it is possible to position the thermal transfer ribbon 3 at the central position of the transfer path 8, and to set the thermal transfer ribbon 3 in the center alignment manner.

It is possible to center-align the continuous label body 6 in the transfer path 8 in accordance with the thermal transfer ribbon 3 by manually operating one of the one-side contact plate 40 and the aligning plate 41 in the aligning device 38 (FIG. 8) in accordance with the center alignment of the thermal transfer ribbon 3 by the aligning device 12. Further, it is possible to guide the continuous label body 6 at the center of the transfer path 8 by manually operating one of the one-side contact plate 54 and the guiding plate 55 in the aligning device 52 (FIG. 10).

Here, in the case in which the thermal transfer ribbon 3 is set in the one-end aligned manner and it is not necessary to position the thermal transfer ribbon at the central position of the transfer path 8, the core tube 21 of the thermal transfer ribbon 3 can be pushed in to the most inward portion (one-side contact circular plate 23) by pulling the hollow core 37 out by preventing the positioning projection 20 from projecting through the positioning engagement hole 26 by pushing the hollow core 37 into the cylindrical shaft 22 to bring the hollow core 37 into contact with the one-side contact circular plate 23 as shown especially in FIG. 7, and further by maintaining the positioning projection 20 in the set-in state within the cylindrical shaft 22 by operating the locking knob 36 such that the sectorial locking plate 35 is engaged with the locking end 20A of the positioning projection 20, that is, without using the function of the aligning device 12.

Further, in the aligning device 38, as shown by the imaginary line in FIG. 9, it is possible to fix the one-side contact plate 40 to the supporting shaft 39 by fixing the bolts 48 again to the one-end aligning bolt holes 51, and to move only the aligning plate 41 along the supporting shaft 39 according to the width of the continuous label body 6, thereby aligning the continuous label body 6 in the one-end alignment manner.

Moreover, in the aligning device 52, as shown by the imaginary line in FIG. 10, it is possible to fix the one-side contact plate 54 to the supporting shaft 53 by fixing the bolts 61 again to the one-end aligning bolt holes 65, and to move only the guiding plate 55 along the supporting shaft 53 according to the width of the continuous label body 6, thereby guiding the continuous label body 6 in the one-end alignment manner.

In this manner, while employing the one-end supporting as the thermal printer 1, it is possible to align the thermal transfer ribbon 3 and the continuous label body 6 as the printing member either at the central position or at an one-end aligning position of the transfer path 8 by the same operation, thereby allowing the user to select the aligning method taking the compatibility of the printing data and such into account.

While the aligning device for the printing member according to the present invention can be provided for the supplying unit 7 for the continuous label body 6, it is desirable to employ the present invention in the supplying unit 4 for the thermal transfer ribbon 3 that is thinner in which the problems in printing quality and meandering due to the used portion of the print head (thermal head 66) are more likely to occur.

The invention claimed is:

1. An aligning device for a printing member in a printer, the printer including a supplying unit configured to hold a rolled printing member in a one-end supporting manner; and a printing unit configured to print information of a predetermined content on the printing member that is fed in a strip from the supplying unit to a transfer path, wherein the supplying unit includes:

an attachment tubular shaft having a cylindrical shaft to which a core tube of the printing member is applied from a free end of the cylindrical shaft, and a one-side contact circular plate disposed at a push-in end of the cylindrical shaft which is on an opposite side from the free end, a pinion rotatably provided within the cylindrical shaft of the attachment tubular shaft and on a line across a width direction of the transfer path, a pair of racks extending along an axial direction of the cylindrical shaft, the racks being so positioned and also engaged with the pinion such that the pair of racks are movable in opposite directions from each other;

a push-in projection at a one-side contact end of one of the racks and also projecting in a radial direction of the cylindrical shaft, and configured to push the one of the racks toward the push-in end of the cylindrical shaft by means of a core tube of the printing member;

a positioning projection swingably attached to a positioning end of the other of the racks, and configured to detachably engage with any of a plurality of positioning engagement holes defined in the cylindrical shaft, each engagement hole is at a predetermined interval along the axial direction from the other engagement holes, wherein the push-in projection drives the racks and the pinion by the pushing of the core tube toward the push-in end of the cylindrical shaft, and the positioning projection engages with one of the positioning engagement holes in the cylindrical shaft at a position at which the core tube is determined to be at a central position across the width direction of the transfer path, whereby the core tube is positioned at the central position across the width direction.

2. The aligning device for the printing member in the printer according to claim 1, further comprising a printing member width measuring plate that rotates in conjunction with the pinion, and the one-side contact circular plate of the attachment tubular shaft faces toward the printing member width measuring plate, the printing member width measuring plate rotates as the core tube of the printing member pushes into the cylindrical shaft, thereby providing a predetermined width correspondent interval from the one-side contact circular plate, and as the printing member is fed from the core tube to the transfer path, the one-side contact circular plate rotates while maintaining the width correspondent interval from the printing member width measuring plate, and the width correspondent interval is measured along with this rotation, thereby allowing calculation of a width of the printing member.

3. The aligning device for the printing member in the printer according to claim 2, wherein the cylindrical shaft includes therein:

a first pulley configured to rotate coaxially with the pinion;

a belt that is wound around the first pulley;

a second pulley spaced away from the first pulley and around which the belt is wound; and a bevel gear provided for the second pulley, and the printing member width measuring plate is rotated by the bevel gear, thereby allowing measurement of the width of the printing member.

4. The aligning device for the printing member in the printer according to claim 1, further comprising:

a rack biasing member configured to bias at least one of the racks such that the at least one of the racks decreases the width corresponding to the printing member attached to the cylindrical shaft.

5. The aligning device for the printing member in the printer according to claim 1, further comprising:

a projection biasing member configured to bias the positioning projection such that the positioning projection engages with an end of the core tube through the positioning engagement hole.

6. The aligning device for the printing member in the printer according to claim 1, further comprising:

a hollow core placeable to the cylindrical shaft in an identical manner with the core tube of the printing member, wherein the hollow core is configured to push the push-in projection toward the one-side contact circular plate, and cause the positioning projection to be set into the cylindrical shaft.

7. The aligning device for the printing member in the printer according to claim 6, further comprising:

a sectorial locking plate configured to maintain the positioning projection set into the cylindrical shaft after the hollow core pushes the push-in projection to the one-side contact circular plate and then is pulled out of the cylindrical shaft.

* * * * *